US008550882B2

(12) United States Patent
Shim

(10) Patent No.: US 8,550,882 B2
(45) Date of Patent: Oct. 8, 2013

(54) GAME BALL SURFACE TREATMENT APPARATUS

(75) Inventor: Sang-Bae Shim, Gyeonggi-do (KR)

(73) Assignee: Sang-Bae Shim, Gyeonggi-do (KR)

( * ) Notice: Subject to any disclaimer, the term of this patent is extended or adjusted under 35 U.S.C. 154(b) by 69 days.

(21) Appl. No.: 13/269,403

(22) Filed: Oct. 7, 2011

(65) Prior Publication Data

US 2012/0264357 A1 Oct. 18, 2012

Related U.S. Application Data

(63) Continuation of application No. PCT/KR2010/002182, filed on Apr. 9, 2010.

(30) Foreign Application Priority Data

Apr. 9, 2009 (KR) ..... 10-2009-0030632

(51) Int. Cl.
*B24B 31/00* (2006.01)

(52) U.S. Cl.
USPC ..... 451/103; 451/111; 451/327; 15/21.2

(58) Field of Classification Search
USPC ..... 451/32, 34, 35, 103, 111, 326, 327, 451/328; 15/21.2
See application file for complete search history.

(56) References Cited

U.S. PATENT DOCUMENTS

| | | | | |
|---|---|---|---|---|
| 3,654,655 | A * | 4/1972 | Mitnick | 15/21.2 |
| 3,693,298 | A * | 9/1972 | Ferrara | 451/327 |
| 3,897,658 | A * | 8/1975 | Kobayashi | 451/327 |
| 3,978,623 | A * | 9/1976 | Smith | 451/326 |
| 4,047,343 | A * | 9/1977 | Smith | 451/32 |
| 4,408,417 | A * | 10/1983 | Kobayashi et al. | 451/327 |
| 5,546,629 | A * | 8/1996 | Shim | 15/302 |
| 5,819,351 | A | 10/1998 | Porper | |
| 6,643,881 | B1 * | 11/2003 | Shim | 15/21.2 |
| 8,113,919 | B2 * | 2/2012 | Shim | 451/159 |
| 2002/0077032 | A1 * | 6/2002 | Kondo et al. | 451/32 |
| 2006/0260075 | A1 * | 11/2006 | Sun | 15/21.2 |

FOREIGN PATENT DOCUMENTS

| | | |
|---|---|---|
| KR | 1019980019521 | 6/1998 |
| KR | 100626720 | 9/2006 |

* cited by examiner

*Primary Examiner* — Eileen P. Morgan
(74) *Attorney, Agent, or Firm* — IP & T Group LLP

(57) ABSTRACT

A game ball surface treatment apparatus for abrading, cleaning or polishing game balls includes an outer housing having a base portion and a side wall portion, an inner housing arranged within the outer housing and having a bottom portion and a circumferential wall portion extending upwards from the bottom portion, a damper arranged to interconnect the outer housing and the inner housing, an electric motor fixed to the bottom portion of the inner housing and having an output shaft extending upwards, a rotary disc fixed to the output shaft of the electric motor to support the game balls and provided with an abrading fabric making contact with the game balls, an impeller arranged above the rotary disc to accommodate the game balls in a mutually isolated state, and a lining attached to the circumferential wall portion of the inner housing to make contact with the game balls.

10 Claims, 3 Drawing Sheets

GAME BALL SURFACE TREATMENT APPARATUS

This application is a continuation of PCT/KR2010/002,182 filed on Apr. 9, 2010, which claims priority of Korean patent application number 10-2009-0030632 filed on Apr. 9, 2009. The disclosure of each of the foregoing applications is incorporated herein by reference in its entirety.

FIELD OF THE INVENTION

The present invention pertains to a game ball surface treatment apparatus and, more specifically, to a game ball surface treatment apparatus designed to abrade, clean or polish a plurality of game balls whole rotating the game bans in many different directions.

BACKGROUND OF THE INVENTION

As a rule, billiard balls need to be cleaned as frequently as possible to wipe out chalk powders, dirt, specks and finger marks left on the surfaces of the billiard balls during the course of their use. This is mainly because the billiard balls with soiled or unclean surfaces are unlikely to travel straight when struck by a cue stick, and thus fails to roll as a long distance as a player normally expect, eventually depriving the player of amusement.

Manual cleaning is a traditional method of rendering the billiard balls clean and lustrous. More specifically, the billiard balls are first applied with a cleaning agent one by one and then vigorously rubbed with a soft fabric until the surfaces thereof grow clean. It is usual for commercial billiard halls to provide customers with tens of billiard balls at a time. This means that the number of billiard balls to be cleaned within a given period of time is exceptionally high. The task of manually cleaning so many billiard balls on a one-by-one basis is time-consuming and high onerous. At a large-scale billiard hall where many cueists play the billiard games, no sufficient time is given to clean the used billiard balls for the next cycle of use. This makes it unavoidable to prepare a large number of fresh billiard balls in advance or to employ clerks who should devote themselves to ball cleaning works.

The present inventor has developed a ball cleaning device capable of solving the problems noted above, which was matured into U.S. Pat. No. 5,546,629 on Aug. 20, 1996. The ball cleaning device includes a housing having a sidewall, a top access opening and a bottom, a cleaning fabric provided on an inner surface of the sidewall, a spindle rotatably fitted through the bottom of the housing to extend upwards parallel to the sidewall, a turntable coaxially mounted on the spindle for rotational movement therewith and adapted to support a plurality of game balls, an idle wheel mounted on the turntable for rotation relative to the turntable, the idle wheel having a plurality of compartments arranged along a circumference thereof, each compartment receiving each of the game balls in a spaced-apart relationship with one another, and a means for rotatably driving the spindle and the turntable in unison to enable the game balls to make rolling movement and planetary movement around the spindle so that the idle wheel can be pushed by the game balls into rotation about the spindle.

From the viewpoint of size reduction, weight loss and cost-effectiveness, the present inventor has also developed a ball cleaning and polishing machine, which was matured into U.S. Pat. No. 6,643,881 on Nov. 11, 2003. The ball cleaning and polishing machine includes a housing, a cleaning barrel extending vertically upwards from the housing and having a cylindrical interior surface, a lining provided on the interior surface of the cleaning barrel and having a plurality of protuberances substantially uniformly spaced apart in a circumferential direction of the lining, a turntable adapted to support a plurality of game balls within the cleaning barrel and provided with a cleaning fabric remaining in contact with the game balls, an impeller coaxially provided above the turntable for rotation relative to the turntable and for keeping the game balls isolated from one another, and an electric motor drivingly connected to the turntable for causing the turntable to rotate such that the game balls can be rubbed with the cleaning fabric.

The ball cleaning and polishing machine cited above suffers from a problem in that the billiard balls collide with the lining in the cleaning process, thereby generating vibrations and noises. Since the lining is attached to the inner circumferential surface of the cleaning barrel at a right angle with respect to the turntable, the billiard balls continue to remain on the turntable even if a strong centrifugal force is applied to the billiard balls in the cleaning process. Thus, the billiard balls rotate at a high speed particularly near the outer edge of the turntable. This tends to increase vibrations and noises and reduce cleaning efficiency. The protuberances uniformly spaced apart in a circumferential direction of the lining have a limit in changing the rotation direction of the billiard balls and enhancing the cleaning efficiency. In addition, the ball cleaning and polishing machine cited above has a drawback in that the cleaning fluid supply structure is too complex.

SUMMARY OF THE INVENTION

In view of the above-mentioned or other problems inherent in the prior art devices, it is an object of the present invention to provide a game ball surface treatment apparatus capable of significantly reducing vibrations and noises generated during surface treatment of game balls and efficiently performing surface treatment of game balls with a simplified abrading fluid supply structure.

The object of the present invention stated above can be accomplished by a game ball surface treatment apparatus for abrading, cleaning or polishing game balls, including:

an outer housing having a base portion and a side wall portion;

an inner housing arranged within the outer housing, the inner housing having a bottom portion and a circumferential wall portion extending upwards from the bottom portion;

a damper arranged to interconnect the outer housing and the inner housing;

an electric motor fixed to the bottom portion of the inner housing and provided with an output shaft extending upwards;

a rotary disc fixed to the output shaft of the electric motor to support the game balls and provided with an abrading fabric making contact with the game balls;

an impeller arranged above the rotary disc to accommodate the game balls in a mutually isolated state; and a ring-shaped lining attached to the circumferential wall portion of the inner housing in such a manner as to make contact with the game balls.

In the game ball surface treatment apparatus, the circumferential wall portion of the inner housing may preferably be installed independently of the side wall portion of the outer housing, the bottom portion of the inner housing being attached to the base portion of the outer housing through the damper.

In the game ball surface treatment apparatus, the damper may preferably include a plurality of spring units arranged to interconnect the bottom portion of the inner housing and the base portion of the outer housing.

In the game ball surface treatment apparatus, each of the spring units may preferably include a spring seat member fixed to the bottom portion of the inner housing and having a through-hole, a rod member inserted into the through-hole of the spring seat member and fixed to the base portion of the outer housing, upper and lower spring retainers fitted to the rod member, a large-diameter lower coil spring held between the spring seat member and the lower spring retainer and a small-diameter upper coil spring held between the spring seat member and the upper spring retainer.

In the game ball surface treatment apparatus, the lining may preferably include a fixing portion detachably attached to the circumferential wall portion of the inner housing and a slant portion extending downwards and radially inwards from the fixing portion.

In the game ball surface treatment apparatus, the slant portion of the lining may preferably include an inner circumferential surface making contact with the game balls and a plurality of protrusions arranged along the inner circumferential surface.

In the game ball surface treatment apparatus, the inner circumferential surface of the slant portion may preferably be divided into a first section along which the protrusions are arranged at a substantially equal interval and a second section formed of a planar surface.

In the game ball surface treatment apparatus, the slant portion may preferably be inclined radially inwards at an angle of 20 to 40 degrees with respect to the circumferential wall portion of the inner housing.

The game ball surface treatment apparatus may preferably further include: an abrading fluid supply unit removably attached to the lining to supply abrading fluid to the game balls.

In the game ball surface treatment apparatus, the abrading fluid supply unit may preferably include a pad for absorbing and holding the abrading fluid and an elastically deformable flap for selectively preventing contact of the pad with the game balls depending on a rotation direction of the rotary disc.

DESCRIPTION OF THE PREFERRED EMBODIMENTS

One preferred embodiment of the present invention will now be described in detail with reference to the accompanying drawings.

Figure 1:
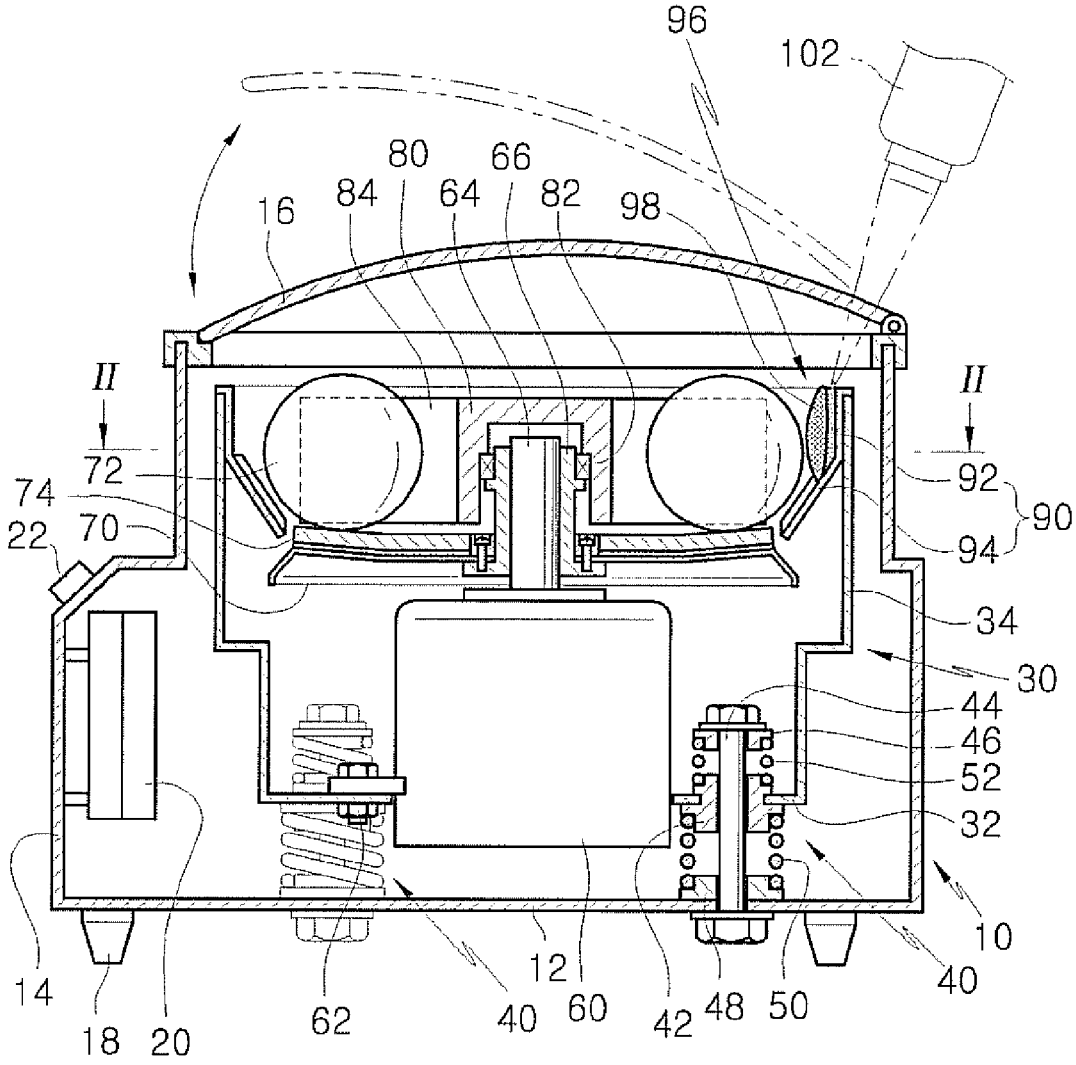
FIG. 1 is a side elevational section view showing a game ball surface treatment apparatus according to a preferred embodiment of the present invention.
Figure 3:
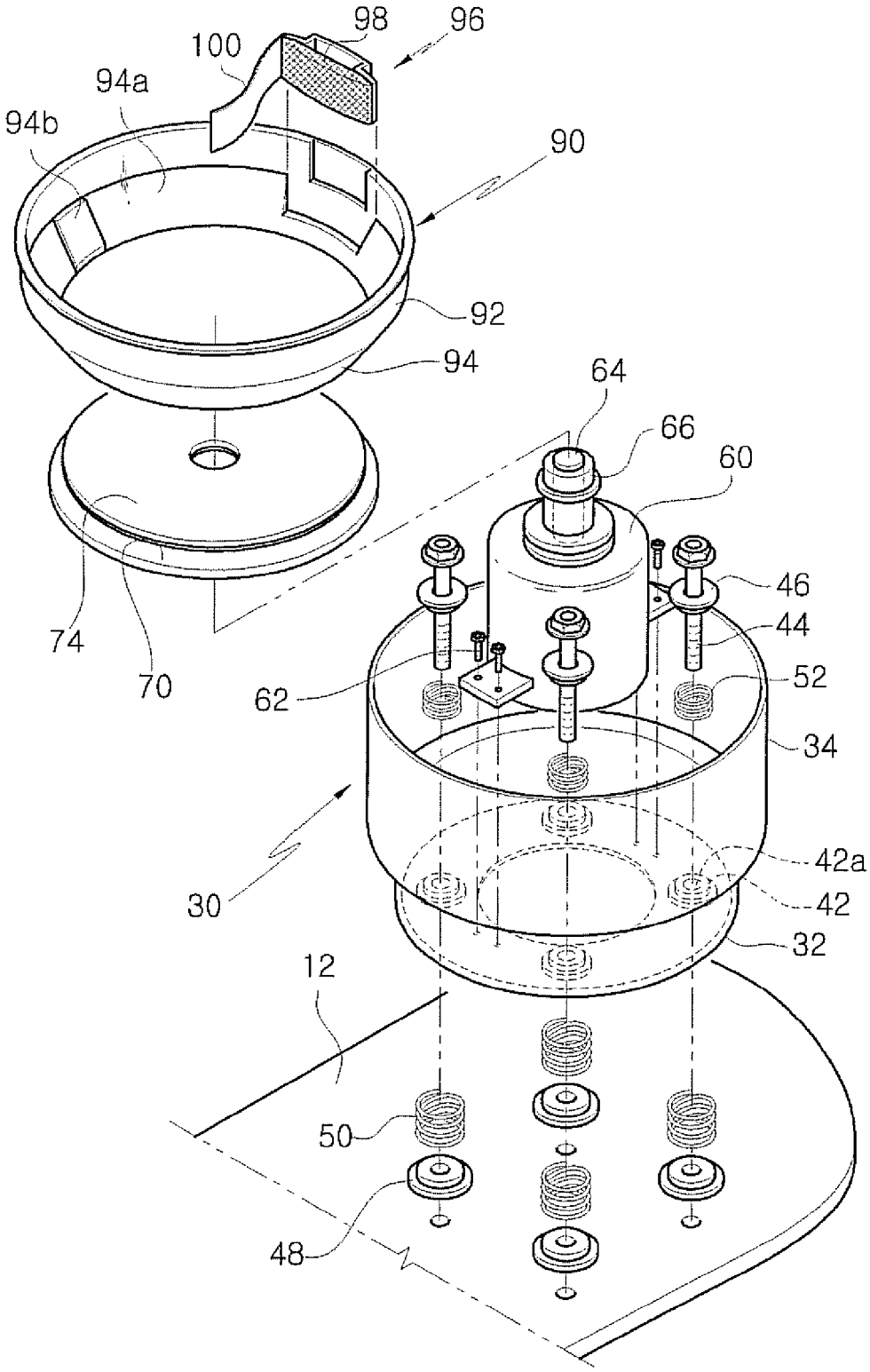
FIG. 3 is an exploded perspective view illustrating a base portion of an outer housing, an inner housing, an electric motor, a rotary disc and a lining employed in the game ball surface treatment apparatus.

Referring to FIGS. 1 and 3, a game ball surface treatment apparatus according to the present invention includes an outer housing 10 and an inner housing 30 arranged within the outer housing 10. The outer housing 10 and the inner housing 30 can be produced by pressing a metal plate or injection-molding a synthetic resin. The outer housing 10 may have any shape as far as it can accommodate the inner housing 30. The inner housing 30 is preferably of an upwardly-opened substantially cylindrical shape.

The outer housing 10 includes a base portion 12, a side wall portion 14 extending upwards from the base portion 12 and a cover 16 openably attached to the upper end of the side wall portion 14. A plurality of legs 18 is attached to the lower surface of the base portion 12. A control board 20 for controlling the operation of a below-mentioned electric motor is fixed to the inner surface of the side wall portion 14. Various kinds of operation switches 22 for inputting user's commands to the control board 20 and a display unit 24 for displaying the operation states of the apparatus are arranged on the front outer surface of the side wall portion 14.

The inner housing 30 includes a bottom portion 32 and a generally-cylindrical circumferential wall portion 34 extending upwards from the bottom portion 32. The bottom portion 32 of the inner housing 30 is connected to the base portion 12 of the outer housing 10 through a plurality of (four, in the present embodiment) spring units 40. The spring units 40 serve as a damper for restraining vibrations from being transferred from the inner housing 30 to the outer housing 10 and for reducing noises. In the present invention, the damper is not limited to the spring units 40. Other dampers such as a rubber bushing and an air damper may be used in place of the spring units 40. The circumferential wall portion 34 of the inner housing 30 is preferably installed independently of the side wall portion 14 of the outer housing 10 with a gap left between the circumferential wall portion 34 and the side wall portion 14. If necessary, the circumferential wall portion 34 of the inner housing 30 and the side wall portion 14 of the outer housing 10 may be connected to each other by an additional damper. In this case, it may be possible to omit the spring units 40.

Each of the spring units 40 includes a spring seat member 42 fixed to the bottom portion 32 of the inner housing 30 and having a through-hole 42*a*, a rod member 44 inserted into the through-hole 42*a* of the spring seat member 42 and fixed to the base portion 12 of the outer housing 10, upper and lower spring retainers 46 and 48 fitted to the rod member 44, a large-diameter lower coil spring 50 held between the spring seat member 42 and the lower spring retainer 48 and a small-diameter upper coil spring 52 held between the spring seat member 42 and the upper spring retainer 46. The spring seat member 42 is preferably made of an elastically deformable material, e.g., rubber. The spring units 40 configured as above enable the spring seat member 42 and the inner housing 30 to move upwards, downwards, frontwards, rearwards, leftwards and rightwards within a limited movement range, thereby absorbing vibrations and reducing noises during a surface treatment process of game balls.

An electric motor 60 is fixed to the bottom portion 32 of the inner housing 30 by means of screws 62. The electric motor 60 includes an output shaft 64 extending upwards. A sleeve 66 is fixed to the output shaft 64 of the electric motor 60. In the present embodiment, the electric motor 60 is a reversible motor having a rotation speed of, e.g., from 1,600 to 1,800 rpm.

A rotary disc 70 is fixed to the sleeve 66 by means of screws and is designed to support a plurality of game balls 72 thereon. The rotary disc 70 includes an abrading fabric 74 removably attached to the upper surface thereof. The abrading fabric 74 has a generally doughnut-like shape and makes frictional contact with the game balls 72 to abrade the surfaces of the game balls 72. The abrading fabric 74, when worn up, can be replaced by a new one. The abrading fabric 74 is preferably made of a soft durable material, e.g., a cotton fabric, which can provide superior abrading, cleaning and polishing effects while keeping the game balls 72 undamaged.

An impeller 80 for accommodating the game balls 72 in a mutually isolated state is rotatably fitted to the sleeve 66 through a bearing 82. The impeller 80 is arranged above the rotary disc 70 in a spaced-apart relationship with the rotary disc 70. The impeller 80 includes, e.g., six radially extending blades 84. The number of the blades 84 may be less than or greater than six. The blades 84 serve to isolate the game balls 72 placed on the rotary disc 70, thereby preventing the game balls 72 from colliding with each other in abrading, cleaning and polishing processes to be described later. As the rotary disc 70 makes rotation, the impeller 80 is pushed by the game balls 72 moving together with the rotary disc 70 and is rotated at a speed far lower than the rotation speed of the rotary disc 70. This allows the game balls 72 to make planetary movement about the output shaft 64 of the electric motor 60.

A generally ring-shaped lining 90 is detachably attached to the circumferential wall portion 34 of the inner housing 30 in such a manner as to make contact with the game balls 72. The lining 90 is used to absorb shocks applied to the inner housing 30 by the game balls 72 and to reduce noises in abrading, cleaning and polishing processes to be described later. The lining 90 is made of, e.g., a relatively soft rubber material having a chemical resistance and a heat resistance.

The lining 90 includes a fixing portion 92 detachably attached to the circumferential wall portion 34 of the inner housing 30 and a slant portion 94 extending radially inwards and downwards from the fixing portion 92. The lower edge of the slant portion 94 is adjacent to the outer edge of the rotary disc 70. The slant portion 94 of the lining 90 includes an inner circumferential surface 94*a* making contact with the game balls 72 and a plurality of protrusions 94*b* arranged along the inner circumferential surface 94*b*. The protrusions 94*b* serve to change the rotation directions of the game balls 72 rotating in contact with the lining 90.

Figure 2:
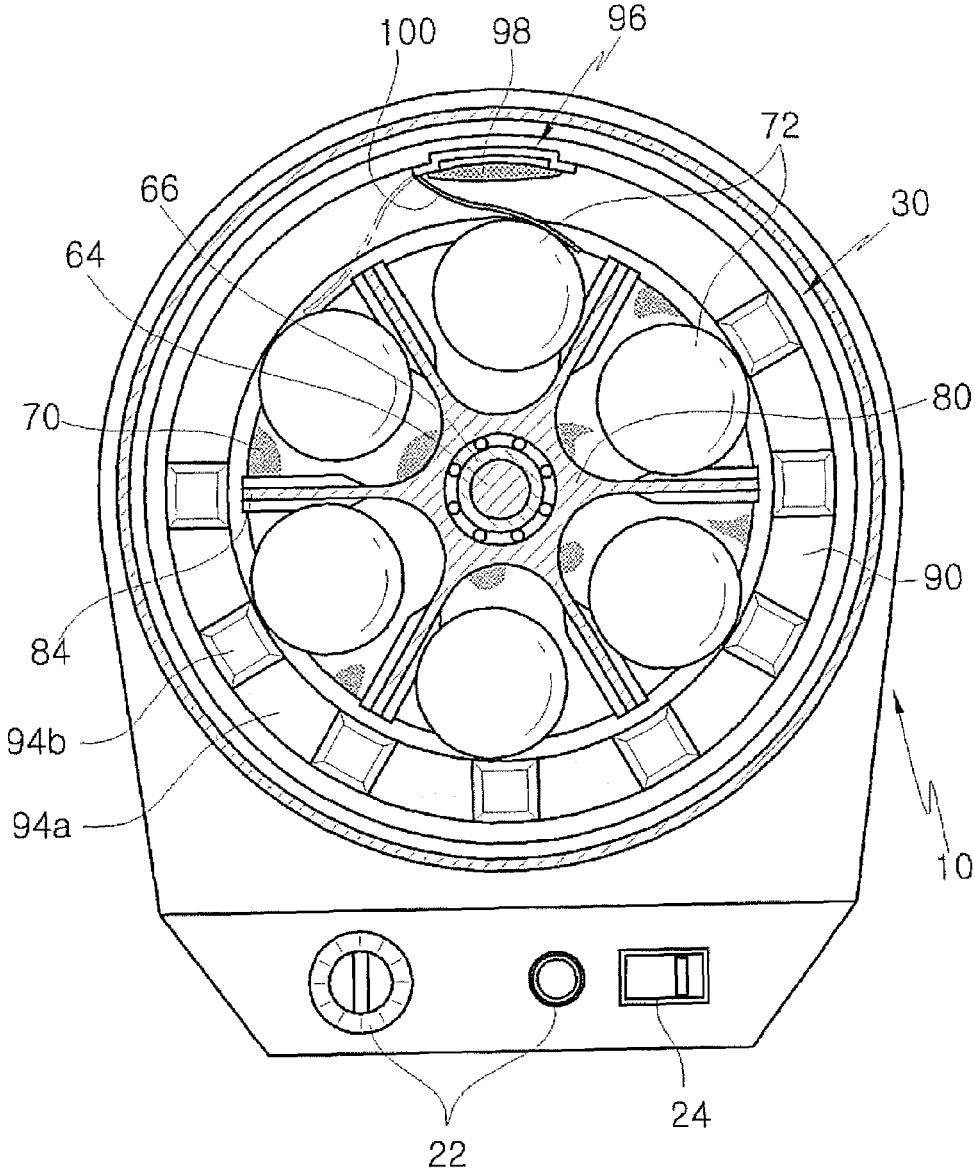
FIG. 2 is a horizontal section view of the game ball surface treatment apparatus taken along line II-II in FIG. 1.

The inner circumferential surface 94*a* of the slant portion 94 is divided into a first section (extending from the two o'clock position to the nine o'clock position in FIG. 2) along which the protrusions 94*b* are arranged at a substantially equal interval and a second section (extending from the nine o'clock position to the two o'clock position in FIG. 2) composed of a planar surface with no protrusion. The reason for providing the first section and the second section is to make the rotation direction and rotation speed of the game balls 72 irregular, thereby uniformly abrading, cleaning or polishing the surfaces of the game balls 72.

The slant portion 94 is preferably is inclined radially inwards and downwards at an angle of, e.g., from 20 to 40 degrees, with respect to the circumferential wall portion 34 of the inner housing 30. If a strong centrifugal force is applied to the game balls 72 during rotation of the rotary disc 70, the game balls 72 are moved radially outwards and upwards along the slant portion 94 and therefore kept out of contact with the rotary disc 70. As a result, it is possible to prevent the game balls 72 from rotating at an unduly high speed, consequently reducing vibrations and noises generated by the game balls 72.

An abrading fluid supply unit 96 is attached to the lining 90. The abrading fluid supply unit 96 includes a pad 98 for absorbing and holding an abrading fluid and an elastically deformable flap 100 for selectively preventing contact of the pad 98 with the game balls 72 depending on the rotation direction of the rotary disc 70. The pad 98 is arranged to make contact with the game balls 72 and apply the abrading fluid on the game balls 72 in an abrading process. The pad 98 is made of a liquid-absorbing material such as a spongy or a cotton fabric. The term "abrading fluid" used herein means a fluid added with an abrading agent at a specified concentration. The abrading fluid is contained in a small container 102 and injected into the pad 98 if such a need arises.

If the rotary disc 70 rotates clockwise (in cleaning and polishing processes), the flap 100 hides the pad 98 as indicated by a solid line in FIG. 2 to prevent the game balls 72 from making contact with the pad 98, ensuring that the abrading fluid is not applied on the game balls 72. In contrast, if the rotary disc 70 rotates counterclockwise (in an abrading process), the flap 100 exposes the pad 98 as indicated by a single-dot chain line in FIG. 2, thereby allowing the game balls 72 to make contact with the pad 98 so that the abrading fluid can be applied on the game balls 72.

Next, description will be made on the operation of the game ball surface treatment apparatus configured as above.

The game balls 72 are first placed on the abrading fabric 74 of the rotary disc 70. The abrading fluid is injected into the pad 98 of the abrading fluid supply unit 96. The cover 16 is closed. If a start button is pushed, the electric motor 60 turns in a forward direction to start an abrading process. As the rotary disc 70 is rotated counterclockwise in FIG. 2, the game balls 72 rotate about their own axes by the frictional contact with the abrading fabric 74 while making planetary movement about the output shaft 64 in the counterclockwise direction. Due to such planetary movement of the game balls 72, the impeller 80 is pushed by the game balls 72 and is slowly rotated counterclockwise. If an increased centrifugal force is applied to the game balls 72 during the planetary movement, the game balls 72 moves radially outwards and upwards along the slant portion 94 of the lining 90 and gets out of contact with the rotary disc 70. This helps prevent the game balls 72 from rotating at an unduly high speed, thereby reducing vibrations and noises generated by the collision of the game balls 72 with the lining 90.

As the rotary disc 70 and the impeller 80 are turned counterclockwise, the flap 100 is bent counterclockwise as indicated by a single-dot chain line in FIG. 2, thereby exposing the pad 98. As a result, the abrading fluid is applied on the game balls 72, greatly enhancing the abrading efficiency. In the abrading process, the spring units 40 restrain the vibration of the inner housing 30 from being transferred to the outer housing 10, consequently reducing the vibrations and noises generated in the apparatus. The abrading process stated above is continuously performed for a predetermined time period.

If the abrading process comes to an end, the electric motor 60 is turned in the reverse direction to start a cleaning or polishing process. As the rotary disc 70 is rotated clockwise in FIG. 2, the game balls 72 rotate about their own axes by the frictional contact with the abrading fabric 74 while making planetary movement about the output shaft 64 in the clockwise direction. Due to such planetary movement of the game balls 72, the impeller 80 is pushed by the game balls 72 and is slowly rotated clockwise. If an increased centrifugal force is applied to the game balls 72 during the planetary movement, the game balls 72 moves radially outwards and upwards along the slant portion 94 of the lining 90 and gets out of contact with the rotary disc 70. This helps prevent the game balls 72 from rotating at an unduly high speed, thereby reducing vibrations and noises generated by the collision of the game balls 72 with the lining 90.

As the rotary disc 70 and the impeller 80 are turned clockwise, the flap 100 is bent clockwise as indicated by a solid line in FIG. 2, thereby hiding the pad 98. As a result, the abrading fluid is not applied on the game balls 72. In the abrading process, the spring units 40 restrain the vibration of the inner housing 30 from being transferred to the outer housing 10, consequently reducing the vibrations and noises generated in the apparatus. The cleaning or polishing process stated above is continuously performed for a predetermined time period.

After the abrading, cleaning and polishing are finished through the processes set forth above, the cover 16 is opened and the game balls 72 are taken out. The abrading fabric 74, the lining 90 and the abrading fluid supply unit 96 may be replaced by new ones after the game ball surface treatment apparatus is used for a long period of time.

INDUSTRIAL APPLICABILITY

The game ball surface treatment apparatus can be used in abrading, cleaning or polishing game balls such as billiard balls or golf balls.

What is claimed is:

1. A game ball surface treatment apparatus for abrading, cleaning or polishing game balls, comprising:

an outer housing having a base portion, a side wall portion and a cover openably attached to an upper end of the side wall portion;

an inner housing arranged within the outer housing, the inner housing having a bottom portion and a circumferential wall portion extending upwards from the bottom portion;

a damper arranged to interconnect the outer housing and the inner housing;

an electric motor fixed to the bottom portion of the inner housing and provided with an output shaft extending upwards;

a rotary disc arranged within the inner housing and fixed to the output shaft of the electric motor to support the game balls, the rotary disc provided with an abrading fabric making contact with the game balls;

an impeller arranged within the inner housing and above the rotary disc to accommodate the game balls in a mutually isolated state; and a ring-shaped lining attached to the circumferential wall portion of the inner housing in such a manner as to make contact with the game balls.

2. The apparatus as recited in claim 1, wherein the circumferential wall portion of the inner housing is installed independently of the side wall portion of the outer housing, the bottom portion of the inner housing being attached to the base portion of the outer housing through the damper.

3. The apparatus as recited in claim 2, wherein the damper includes a plurality of spring units arranged to interconnect the bottom portion of the inner housing and the base portion of the outer housing.

4. The apparatus as recited in claim 3, wherein each of the spring units includes a spring seat member fixed to the bottom portion of the inner housing and having a through-hole, a rod member inserted into the through-hole of the spring seat member and fixed to the base portion of the outer housing, upper and lower spring retainers fitted to the rod member, a large-diameter lower coil spring held between the spring seat member and the lower spring retainer and a small-diameter upper coil spring held between the spring seat member and the upper spring retainer.

5. The apparatus as recited in claim 1, wherein the lining includes a fixing portion detachably attached to the circumferential wall portion of the inner housing and a slant portion extending downwards and radially inwards from the fixing portion.

6. The apparatus as recited in claim 5, wherein the slant portion of the lining includes an inner circumferential surface making contact with the game balls and a plurality of protrusions arranged along the inner circumferential surface.

7. The apparatus as recited in claim 6, wherein the inner circumferential surface of the slant portion is divided into a first section along which the protrusions are arranged at a substantially equal interval and a second section formed of a planar surface.

8. The apparatus as recited in claim 5, wherein the slant portion is inclined radially inwards at an angle of 20 to 40 degrees with respect to the circumferential wall portion of the inner housing.

9. The apparatus as recited in claim 1, further comprising:

an abrading fluid supply unit removably attached to the lining to supply abrading fluid to the game balls.

10. The apparatus as recited in claim 9, wherein the abrading fluid supply unit includes a pad for absorbing and holding the abrading fluid and an elastically deformable flap for selectively preventing contact of the pad with the game balls depending on a rotation direction of the rotary disc.

* * * * *